United States Patent [19]

Peghetti

[11] Patent Number: 4,688,492

[45] Date of Patent: Aug. 25, 1987

[54] TWO DOOR SAFE

[75] Inventor: Ferruccio G. Peghetti, Milan, Italy

[73] Assignee: Lips Vago SpA, Milan, Italy

[21] Appl. No.: 934,375

[22] Filed: Nov. 24, 1986

[51] Int. Cl.[4] ..... E05G 1/00; E05C 7/04

[52] U.S. Cl. ..... 109/56; 109/59 T; 70/DIG. 63; 49/367; 292/DIG. 21

[58] Field of Search ..... 109/53-56, 109/59 R, 59 T; 70/DIG. 63, DIG. 65, DIG. 66; 49/366, 367; 292/153, DIG. 21, DIG. 69

[56] References Cited

U.S. PATENT DOCUMENTS

| | | | |
|---|---|---|---|
| 279,334 | 6/1883 | Clark | 292/DIG. 21 |
| 423,095 | 3/1890 | Teal et al. | 109/56 |
| 2,027,353 | 1/1936 | Bennett et al. | 109/56 |

FOREIGN PATENT DOCUMENTS

| | | | |
|---|---|---|---|
| 1591846 | 6/1981 | United Kingdom . | |
| 912897 | 3/1982 | U.S.S.R. | 49/367 |

*Primary Examiner*—Gary L. Smith
*Assistant Examiner*—Neill Wilson
*Attorney, Agent, or Firm*—Jerry A. Miller

[57] ABSTRACT

The internal space of a safe is subdivided into two compartments lying side by side by a vertical partition provided with a reinforced vertical upright. A reinforced closure door comprises two leaves adapted to be closed in succession, each having its own locking mechanism with bolts adapted to engage in said upright in their thrown position. The bolts of the two mechanisms are made functionally interdependent by means of pivotal latch members borne by the partition which lock in the thrown position the bolts of the second-to-close door leaf in response to the throwing of the bolts of the first-to-close door leaf.

2 Claims, 8 Drawing Figures

TWO DOOR SAFE

BACKGROUND

The present invention relates to a safe having two interior compartments and two door leaves, with means for interlocking the same.

Safes are known which have two-leaved doors for closing the single compartment in their interior. The two leaves are usually adapted to be closed in a predetermined sequence and are provided with respective locking mechanisms comprising locks and bolts, which in some cases interact with one another and with the body of the adjacent door leaf in such a manner that the locking mechanism of the leaf closed first will, when in the locking position, prevent the unlocking of the leaf closed last and the successive opening of that leaf. In this way neither door of the safe can be opened unless both the locking mechanisms have been released. A safe of this kind is for example described in United Kingdom Patent Specification No. 1591846.

SUMMARY

The present invention seeks to provide a two-door safe of the same general character as described above but of potentially greater strength against forcing, while employing mechanically simple and compact means for interlocking the two doors.

Accordingly, the invention provides a safe comprising partition means subdividing the interior of the safe into two compartments; first and second door leaves adapted to close respective said compartments and being mutually configured such that the first door leaf can open only after the second door leaf has opened; the door leaves being provided with respective locking mechanisms each including bolts adapted to engage in said partition means when thrown; and means for interlocking the locking mechanisms of the two door leaves, which means comprise pivotal latches borne by said partition means and adapted to be moved by the throwing of said bolts of the first door leaf into engagement with the thrown said bolts of the second door leaf, such that said bolts of the second door leaf can be withdrawn from the partition means only after said bolts of the first door leaf have been withdrawn.

In one arrangement said latches are generally U-shaped and each one is biased resiliently to a position in which one arm thereof lies in the path of throwing movement of a respective said bolt of the first door leaf; the other arm of the latch being inserted into a notch provided in a respective said bolt of the second door leaf when the latch is displaced by the respective said bolt of the first door leaf.

The nature of the present invention will become more fully apparent from the ensuing detailed description of a preferred embodiment thereof, taken in conjunction with the accompanying drawings.

DESCRIPTION OF THE PREFERRED EMBODIMENT

Figure 1:
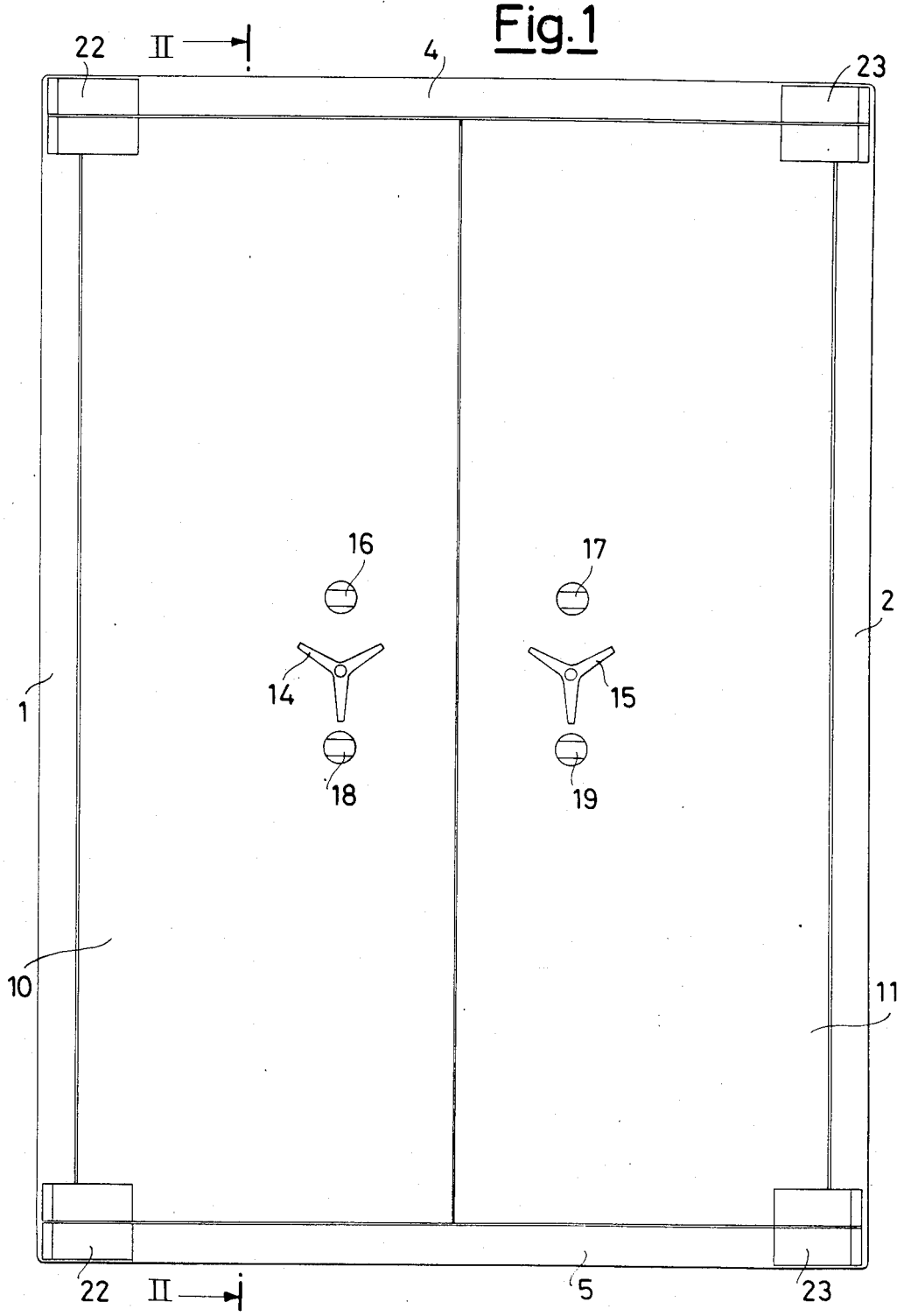
FIG. 1 is a front view of a two-door safe made in accordance with the invention.
Figure 2:
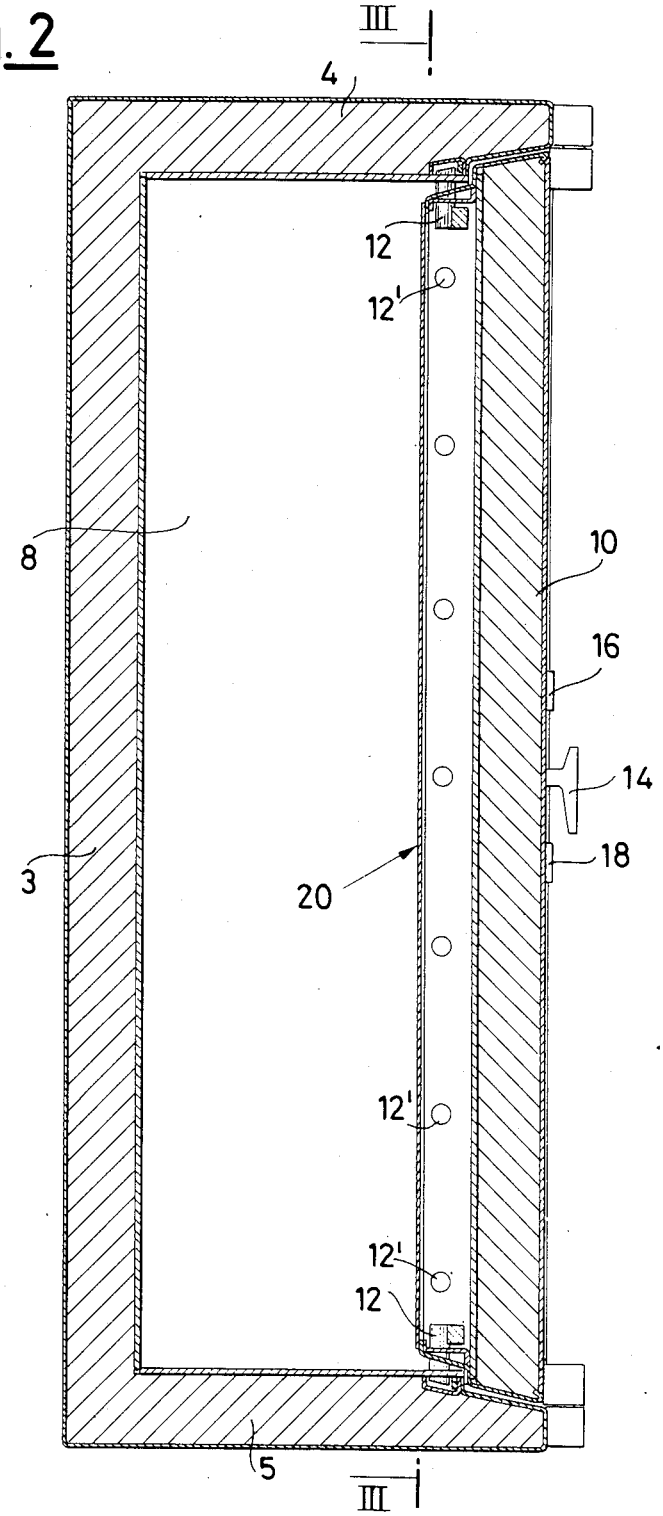
FIG. 2 shows the safe in a vertical section on the line II—II in FIG. 1.

The safe shown in the drawings comprises side walls 1 and 2, a rear wall 3, a top wall 4 and a bottom wall 5, which are appropriately armoured to withstand attack by burglars. These walls define an interior space subdivided into two equal compartments 6 and 7, disposed side by side, by a vertical partition 8 provided with an armoured front upright 9, which extends from the top wall 4 to the bottom wall 5.

Figure 3:
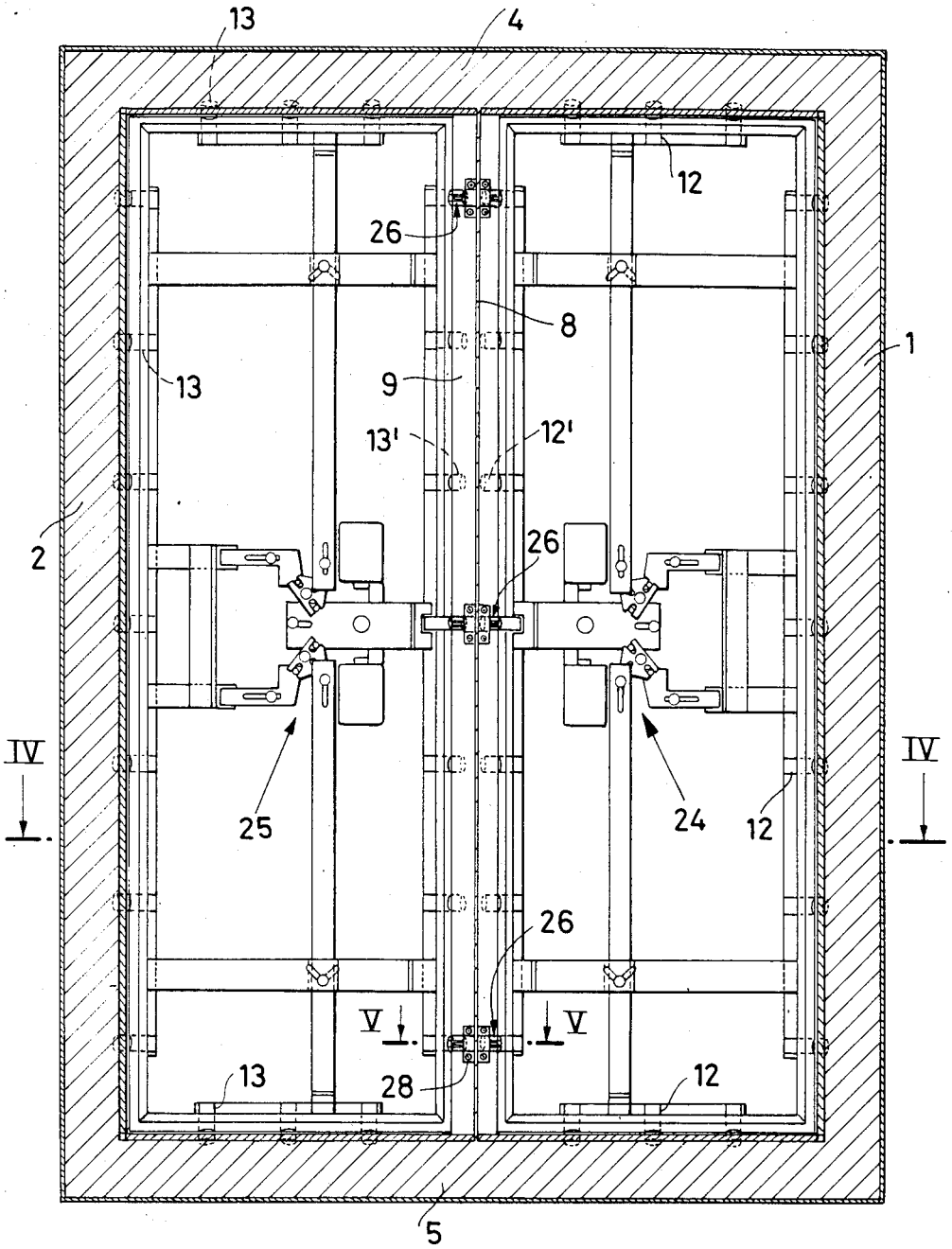
FIG. 3 is another vertical section of the safe, taken on the line III—III in FIG. 2.

The two compartments 6 and 7 can be closed in a predetermined sequence by means of the respective leaves 10 and 11 of a two-leaved door, which is likewise suitably armoured. Each of the two door leaves 10 and 11, which turn on hinges 22 and 23, is provided with a respective locking mechanism 20, 21 consisting of bolts 12, 13 and 12′, 13′ connected by an appropriate linkage 24, 25 known per se (FIG. 3), an operating handwheel 14, 15, a securing lock 16, 17, and a refastening lock 18, 19. The bolts 12 and 13 are received in the side, top and bottom walls of the safe, and the bolts 12′ and 13′ are received in the armoured upright 9, in order to effect the necessary locking of the two leaves 10 and 11 in the closed position.

Figure 5:
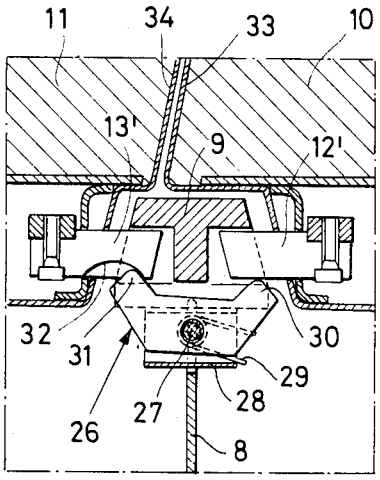
FIG. 5 shows on a larger scale a detail of one of the pivotal latches for the interconnection of the locking mechanism of the two door leaves, in section on the line V—V in FIG. 3.
Figure 6:
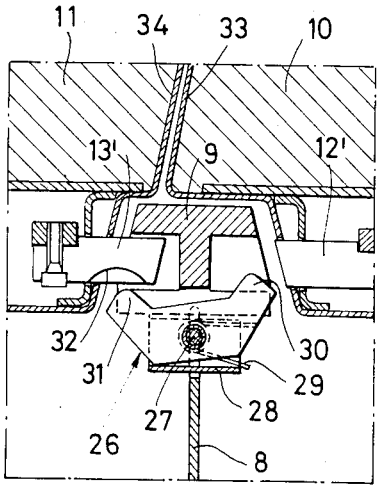
FIGS. 6 to 8 show the same latch in successive phases of the operation of opening the safe.
Figure 7:
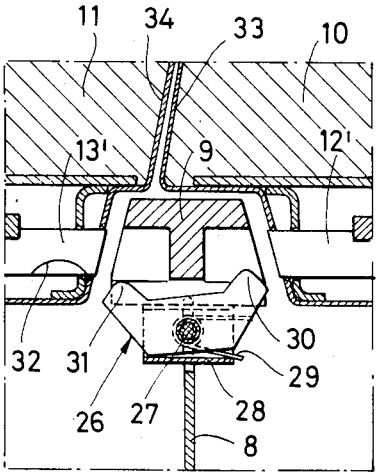
Figure 8:
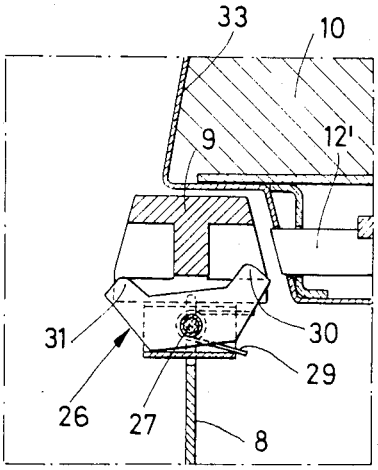

As shown in FIG. 3 and 5 to 8, the bolts 12′ and 13′ which are engaged in the central upright 9 are functionally interconnected by means of a plurality of U-shaped latches 26, which are pivoted at 27 on respective supports 28 fastened to the upright 9 and are resiliently urged by a respective spring 29 into the position of rest shown in FIGS. 6 to 8. In this position the bolts 13′ are free to slide axially between their withdrawn position shown in FIG. 7 and their thrown position shown in FIGS. 5 and 6, while one arm 30 of each latch 26 lies in the path of the corresponding bolts 12′ situated in their withdrawn position. When the bolts 12′ are moved forward into their thrown position, however, those situated facing the latches 26 engage the arms 30 of the latter in such a manner as to pivot the latches 26 to the operative position shown in FIG. 5, in which, if the bolts 13′ have in turn previously been moved to their thrown position, the other arms 31 of the latches 26 are inserted into corresponding notches 32 in the corresponding bolts 13′ in order to lock the same in the thrown position until the bolts 12′ are successively withdrawn.

Figure 4:
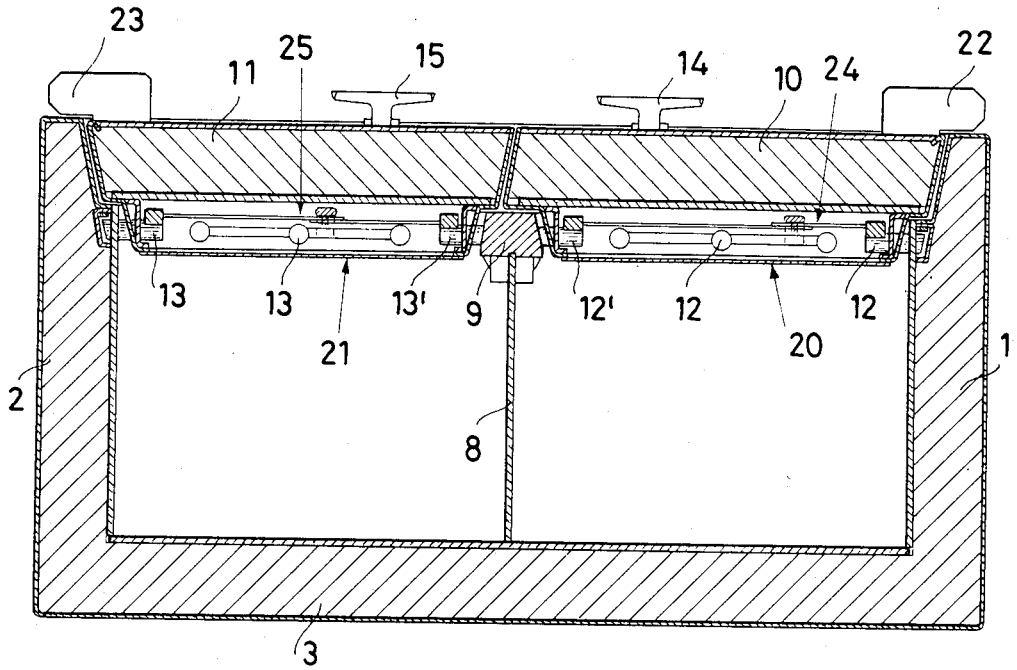
FIG. 4 is a horizontal section of the safe on the line IV—IV in FIG. 3.

This provides the following methods of closing and opening the two-leaved door. The leaf 10 is closed first (FIG. 8) and then the leaf 11 (FIG. 7), as dictated by the complementary shape of the two mutually facing edges 33 and 34 of the two leaves (FIGS. 4 and 7). The handwheel 15 of the leaf 11 is then turned to move the bolts 13 and 13′, by means of the mechanism 25, into the thrown position shown in FIGS. 2–4 and 6, which can then be secured and resecured by means of the locks 17 and 19. The handwheel 14 of the leaf 10 is then turned to move the bolts 12 and 12′, by means of the mechanism 24, into the thrown position shown in FIGS. 214 5, which can then be secured and resecured by means of the locks 16 and 18. As already stated, the forward movement of the bolts 12′ brings about the turning of the latches 26, which by means of their arms 30 engaged and held by the bolts 12' are forced to engage their opposite arms 31 in the corresponding notches 32 in the bolts 13' (FIG. 5). The door of the safe thus closed and locked.

In this state the door cannot be reopened by acting on a single door leaf and the respective locking mechanism. The bolts 13 and 13' of the leaf 11 are in fact held in the thrown position by the latches 26, which in turn are held by the bolts 12' so that they can be returned to the position of rest only if the bolts 12 and 12', that is to say the locking mechanism of the leaf 10, have first been returned to the unlocking position. The leaf 10 can moreover be opened only if the leaf 11 has first been opened.

In point of fact, in order to open the door it is necessary to act on the locking mechanisms of both the door leaves, by the following procedure. Starting from the situating shown in FIGS. 2–5, by releasing the locks 16 and 18 and turning the handwheel 14 the locking mechanism 20 of the leaf 10 is operated to draw back the bolts 12 and 12', with the consequent return of the latches 26 to the position of rest and the freeing of the bolts 13' (FIG. 6). By releasing the locks 17 and 19 and turning the handwheel 19 the locking mechanism 21 of the leaf 11 is then operated to draw back the bolts 13 and 13' (FIG. 7). At this point the leaf 11 can be opened (FIG. 8), thus enabling the leaf 10 to be opened in turn.

I claim:

1. A safe comprising partition means subdividing the interior of the safe into two compartments; first and second door leaves adapted to close respective said compartments and being mutually configured such that the first door leaf can open only after the second door leaf has opened; the door leaves being provided with respective locking mechanisms each including bolts adapted to engage in said partition means when thrown; and means for interlocking the locking mechanisms of the two door leaves, which means comprise pivotal latches borne by said partition means and adapted to be moved by the throwing of said bolts of the first door leaf into engagement with the thrown said bolts of the second door leaf, such that said bolts of the second door leaf can be withdrawn from the partition means only after said bolts of the first door leaf have been withdrawn.

2. A safe according to claim 1 wherein said latches are generally U-shaped and each one is biased resiliently to a position in which one arm thereof lies in the path of throwing movement of a respective said bolt of the first door leaf; the other arm of the latch being inserted into a notch provided in a respective said bolt of the second door leaf when the latch is displaced by the respective said bolt of the first door leaf.

* * * * *